US005562856A

United States Patent [19]

Jeschke et al.

[11] Patent Number: 5,562,856

[45] Date of Patent: Oct. 8, 1996

[54] POURABLE, LIQUID WATER-BASED CLEANING CONCENTRATES

[75] Inventors: Rainer Jeschke; Eva Kiewert, both of Duesseldorf; Karl-Heinz Disch, Haan; Katica Bocarac, Duesseldorf, all of Germany

[73] Assignee: Henkel Kommanditgesellschaft auf Aktien, Duesseldorf, Germany

[21] Appl. No.: 387,880

[22] PCT Filed: Aug. 13, 1993

[86] PCT No.: PCT/EP93/02159

§ 371 Date: Feb. 22, 1995

§ 102(e) Date: Feb. 22, 1995

[87] PCT Pub. No.: WO94/04648

PCT Pub. Date: Mar. 3, 1994

[30] Foreign Application Priority Data

Aug. 22, 1992 [DE] Germany ..... 42 27 863.5

[51] Int. Cl.[6] ..... C11D 9/00; C11D 15/00; C11D 1/12

[52] U.S. Cl. ..... 510/428; 510/236; 510/509; 510/268

[58] Field of Search ..... 252/108, 173, 252/174.11, 174.14, 174.12, 174.19, 123, 550

[56] References Cited

U.S. PATENT DOCUMENTS

| | | | |
|---|---|---|---|
| 3,862,050 | 1/1975 | Aubert | 252/110 |
| 4,576,738 | 3/1986 | Colodney et al. | 252/559 |
| 4,915,864 | 4/1990 | Kita et al. | 252/117 |
| 4,933,101 | 6/1990 | Cilley et al. | 252/99 |
| 5,286,402 | 2/1994 | Geke et al. | 252/121 |
| 5,342,534 | 8/1994 | Skrobala et al. | 252/174.17 |
| 5,415,813 | 5/1995 | Misselyn et al. | 252/DIG. 1 |

*Primary Examiner*—Anthony McFarlane
*Assistant Examiner*—Patricia L. Hailey
*Attorney, Agent, or Firm*—Ernest G. Szoke; Wayne C. Jaeschke; Real J. Grandmaison

[57] ABSTRACT

A pourable, aqueous cleaning composition containing:

(a) at least 50% by weight of sodium bicarbonate having a mean particle size of about 200±100 μm;

(b) from about 2 to 30% by weight of a surfactant mixture selected from alkyl sulfates, alkyl ether sulfates, narrow-range alkyl polyglycol ethers and soap; and (c) the remainder, water.

20 Claims, No Drawings

POURABLE, LIQUID WATER-BASED CLEANING CONCENTRATES

BACKGROUND OF THE INVENTION

FIELD OF THE INVENTION

This invention relates to pourable, liquid water-based cleaning concentrates which may be used both as scouring cleaners and in dilute form as multipurpose cleaners. Cleaning compositions of the type in question are known and are based on the use inter alia of water-soluble abrasive components which perform the scouring function in concentrated media and largely dissolve in dilute media, but can readily be removed from the substrate after application simply by rinsing with water.

DISCUSSION OF RELATED ART

U.S. Pat. No. 4,179,414 describes stable pastes of about 50 to 65% by weight of sodium bicarbonate, about 50 to 35% by weight of water, about 5 to 20% by weight of sodium chloride and 10 to 30% by weight of $C_{12-16}$ fatty acid diethanolamide (based on the water content) which, in concentrated form, have a scouring effect and, in dilute form, clean hard surfaces. The particle size of the sodium bicarbonate is not mentioned. EP 0 193 375 A2 describes liquid cleaners of the type in question which may contain 1.5 to 30% by weight of surfactants and inter alia 6 to 35% by weight of sodium bicarbonate with a mean particle diameter of 10 to 500 μm (more precise figures are not provided). The rest consists of water. EP 0 334 556 A2 describes water-based cleaners of the type in question which contain 1.5 to 40% by weight of surfactants, 2.0 to 65% by weight of predominantly undissolved potassium sulfate with the same particle size as mentioned above, preferably 20 to 300 μm, and optionally 0.5 to 10% by weight of sodium chloride. International patent application WO 91/08282 describes liquid scouring cleaners with water-soluble abrasives which may contain 1.5 to 30% by weight of surfactants, about 45 to about 75% by weight of sodium bicarbonate with a small mean particle size of specifically less than 80 μm and more than 10% by weight of water.

Whereas most of these known cleaning compositions foam excessively in use and/or in terms of their abrasive effect fail to reach the commercial standard of marble powder on account of their inadequate particle size, the cleaners which have been developed in accordance with the present invention do not have any of these disadvantages.

It is much more difficult to form a stable dispersion from relatively large particles than from relatively fine particles because, under Stokes' law on the sedimentation of dispersed particles (see equation 1), the sinking rate V depends upon the square of the radius r of the particles and upon the viscosity n of the medium. It increases with increasing radius, which is equivalent to destabilization, and falls with increasing viscosity, which is equivalent to stabilization.

Equation 1:

$$V = \frac{2*r^2*(-o)*g}{*g}$$

The viscosity of very fine-particle dispersions is considerably higher for the same quantity than that of dispersions of relatively coarse particles (see Examples 1 and 2). Although Stokes's equation does not apply entirely in the above form to high-solids systems like those according to the invention, Stokes' sinking rate V is still included in the approximate equations for more concentrated systems. Accordingly, even in concentrated systems, a relatively large particle radius has a destabilizing effect on the dispersion both through the radius and also through the lower viscosity.

A low-foaming surfactant combination has surprisingly been found which not only develops the required cleaning effect, but also enables considerably coarser sodium bicarbonate compared with the teaching of WO 91/8282 to be stably dispersed. This surfactant combination consists essentially of alkyl polyglycol ether, alkyl sulfate, optionally alkyl ether sulfate and soap, a thickening alkyl polyglycol ether with a narrow distribution of the ethylene oxide adducts (A. Behler et al., Seifen-öle-Fette-Wachse, 116, 60–68 (1990) and DE 38 17 415) being used as the alkyl polyglycol ether, and is additionally distinguished by the fact that the surfactants are readily biodegradable. Foaming is regulated by addition of the soap. Particularly good results are obtained with coconut oil fatty acid, isostearic acid and mixtures thereof. Minimal foaming is nowadays essential for the acceptance of modern domestic cleaners.

DESCRIPTION OF THE INVENTION

Accordingly, the present invention relates to pourable, liquid water-based cleaning concentrates containing surfactants and a water-soluble salt which, in concentrated form, may be used as scouring cleaners and, in dilute form, as multipurpose cleaners, characterized in that they contain a) at least 50 and preferably 50 to 65% by weight of sodium bicarbonate with a mean particle size of around 200±100 μm as the water-soluble salt and b) around 2 to 30 and preferably around 3 to 15% by weight of a low-foaming surfactant mixture of alkyl sulfates and/or alkyl ether sulfates and narrow-range alkyl polyglycol ethers and soap.

In addition to the surfactants mentioned under b), typical alkyl polyglycol ethers with a normal distribution of the ethylene oxide units may also be present.

The low-foaming surfactant mixture consists essentially of around 0 to 13 and preferably around 4 to 10% by weight of alkyl sulfates containing about 8 to 22 and preferably about 9 to 16 carbon atoms in the alkyl radical, around 0 to 13 and preferably around 4 to 10% by weight of alkyl ether sulfates containing about 8 to 18 and preferably about 9 to 16 carbon atoms in the alkyl radical and about 1 to 5 and preferably about 2 to 4 EO in the molecule, around 1.5 to 8 and preferably around 2 to 6% by weight of alkyl polyglycol ethers containing about 8 to 18 and preferably about 9 to 16 carbon atoms in the alkyl radical and about 2 to 8 and preferably about 2 to 5 ethylene oxide units (EO) in the molecule and around 0.05 to 5 and preferably around 0.5 to 3% by weight of a linear or branched, saturated or unsaturated carboxylic acid containing about 7 to 22 and preferably about 10 to 22 carbon atoms in the alkyl radical and/or alkali metal, ammonium and/or alkyl ammonium salts thereof. The individual classes of surfactants may be represented by one or more of their compounds. As usual in oleochemistry, the alkyl (ether) sulfates and alkyl polyglycol ethers may be derived from the technical alcohol mixtures obtained, for example, in the high-pressure hydrogenation of methyl esters based on vegetable or animal starting materials or in the hydrogenation of aldehydes from Roelen's oxo synthesis. The ratio by weight of alkyl (ether) sulfate to alkyl polyglycol ethers is best about 10:1 to 1:10, preferably 5:1 to 1:5 and more preferably 3:1 to 1:4.

The flow properties of the claimed cleaning compositions may be positively influenced by addition of around 0 to 5 and preferably around 0.3 to 3% by weight of polyols corresponding to the formula HO—R—OH, where R is an optionally hydroxyl-substituted alkyl radical containing about 2 to 6 and preferably 2 to 4 carbon atoms. In this way, the cleaning compositions can be made particularly convenient and easy to dose. The polyols include, for example, ethylene glycol, n- and iso-propylene glycols and glycerol.

Another possible addition consists of naturally occurring polymers, such as for example xanthan gum, other polysaccharides and/or gelatine in quantities of around 0 to 2 and preferably around 0.5 to 1.8% by weight. The cleaning performance of the compositions is remarkably increased in this way.

In addition, the cleaning compositions according to the invention may contain typical ingredients, such as inorganic or organic builders, for example in the form of low molecular weight dicarboxylic acids or sodium chloride, known solubilizers, such as hydrotropes and solvents, preservatives, other antimicrobial agents, dyes and fragrances.

Sodium bicarbonate forms a buffer at pH 8.7, i.e. the pH value can only be reduced when the buffer is exhausted; any increase in the pH has an adverse effect on viscosity.

Solubilizers known per se may also be incorporated either individually or in admixture with one another and, in addition to water-soluble organic solvents, such as in particular low molecular weight aliphatic alcohols containing 1 to 4 carbon atoms, also include so-called hydrotropes of the lower alkyl aryl sulfonate type, for example toluene, xylene or cumene sulfonates, or short-chain alkyl sulfates, such as octyl sulfate. They may also be present in the form of their sodium and/or potassium and/or alkylamino salts. Other suitable solubilizers are water-soluble organic solvents, more particularly those with boiling points above 75° C., such as for example the ethers of identical or different polyhydric alcohols or the partial ethers of polyhydric alcohols. These include, for example, di- or triethylene glycol polyglycerols and the partial ethers of ethylene glycol, propylene glycol, butylene glycol or glycerol with aliphatic monohydric alcohols containing 1 to 6 carbon atoms in the molecule.

Other suitable water-soluble or water-emulsifiable organic solvents include ketones, such as acetone or methyl ethyl ketone, aliphatic, cycloaliphatic and aromatic hydrocarbons and terpene alcohols.

The cleaning compositions according to the invention are produced by mixing the ingredients while stirring with a commercial paddle stirrer in the following order: approx. 6% of the total quantity of bicarbonate is dissolved in water at 40° C., after which the fatty acid is added in molten form. When it is homogeneous, the mixture is cooled to 25° C. and the remaining ingredients are added.

EXAMPLES

To demonstrate the advantages of the cleaners according to the invention, tests were carried out by the following methods:

To measure abrasiveness, 6 g of undiluted cleaner was applied to a small sponge which was then moved back and forth twenty times in a circular movement over an area soiled by a combination of condensed milk, castor sugar and cottage cheese powder (50:8:10) baked in at 200° C. under a defined pressure of 2.5 kg. After the soiled plates had been rinsed and dried, the amount of soil removed was calculated and related to the result obtained with a commercial liquid scouring cleaner based on marble powder.

Viscosity was measured in m.Pas using a Brookfield RVT viscosimeter, spindle 4, 20 r.p.m. The measurements were carried out at 20° C.

Cleaning power was tested by the method described below which gives highly reproducible results. The removal of soil from hard surfaces was evaluated by the cleaning power test described in Seifen-öle-Fette-Wachse 112, 371 (1986).

The cleaner to be tested was applied to an artificially soiled plastic surface. A mixture of carbon black, machine oil, triglyceride of saturated fatty acids and low-boiling aliphatic hydrocarbon was used as the artificial soil for the dilute application of the cleaner. The test area of 26×28 cm was uniformly coated with 2 g of the artificial soil using a surface spreader.

A plastic sponge was impregnated with 10 ml of the cleaning solution to be tested and wiped mechanically over the test surface which had also been coated with 10 ml of the cleaning solution to be tested. After 10 wiping movements with a plastic sponge, the cleaned surface was held under running water and the loose soil was removed. The cleaning effect, i.e. the whiteness of the plastic surface thus cleaned, was measured with a Dr. Lange Microcolor color difference measuring instrument. The clean white plastic surface was used as the shire standard. Since the instrument was set to 100% in the measurement of the clean surface and the soiled surface produced a reading of 0, the values read off for the cleaned plastic surfaces can be equated with the percentage cleaning power (% CP). In the following tests, the CP rel. (%) values shown are the values determined by this method for the cleaning power of the cleaners tested, based on the cleaning performance of the cleaner used as standard (CP=100%). They represent the averages of three determinations.

The foaming behavior of the cleaners according to the invention was tested as follows:

The product to be tested was placed in a wide-necked glass beaker. The quantity of tapwater which forms the recommended in-use solution of the product with the quantity of product initially introduced was then run freely into the glass beaker from a height of 30 cm.

The foam height in the glass beaker was read off both immediately after addition of the water and again after an interval of 3 minutes. The foam height after 3 minutes was related to the initial foam and the foam collapse was calculated as follows:

$$\text{Foam collapse (\%)} = \frac{\text{Initial foam height} - \text{foam height after 3 mins.}}{\text{Initial foam height}} \cdot 100$$

A cleaner with a foam collapse of more than 50% was defined as a low-foam cleaner.

In the following Examples, quantities are percentages by weight.

Examples 1 and 2

Examples 1 and 2 are intended to illustrate the connection between particle size and abrasiveness.

| | Example 1 % | Example 2 (comparison) % |
|---|---|---|
| $C_{12/14}$ alkyl sulfate, Na salt | 5 | 5 |
| $C_{12/14}$ FA + 2.5 EO (narrow-range) | 3.5 | 3.5 |
| Cocofatty acid | 1 | 1 |
| Sodium bicarbonate, mean particle diameter 200 μm | 50 | — |
| Sodium bicarbonate, mean particle diameter 63 μm | — | 50 |

-continued

| | Example 1 % | Example 2 (comparison) % |
|---|---|---|
| 1,2-Propylene glycol | 0.5 | 0.5 |
| Perfume | 0.25 | 0.25 |
| Water, deionized | ad 100% | ad 100% |
| Relative abrasiveness | 90% | 70% |
| Viscosity (mPas) | 5000 | 6600 |

A commercial liquid scouring cleaning containing 50% by weight of marble powder was used for comparison, its abrasiveness being put at 100%.

The Examples show that the abrasiveness of marble powder can almost be achieved with sodium bicarbonate having the particle size according to the invention whereas, according to Example 2, the bicarbonate particle size according to WO 91/8282 was distinctly less effective.

EXAMPLE 3

9% $C_{12/14}$ fatty alcohol ether sulfate, Na salt 5.5% $C_{12/14}$ FA +2.5 EO (narrow-range)

1% isostearic acid 1.5% 1,2-propylene glycol

55% sodium bicarbonate, mean particle diameter 200 μm ad 100% water, deionized

Despite the relatively high total surfactant content of 15.5%, this Example represents a low-foaming cleaner. The foam collapse for dilute application (3 ml/l) was 73%. A commercial product containing 50% of sodium bicarbonate for a total surfactant content of 12% was used for comparison and showed a foam collapse of under 43% for an in-use concentration of 3 ml/1.

EXAMPLE 4

2% $C_{12/14}$ fatty alcohol ether sulfate, Na salt

4% $C_{12/14}$ FA +2.5 EO (narrow-range)

1.3% $C_{12/14}$ FA +4 EO (normal range)

0.8% cocofatty acid 0.5% glycerol 0.3% perfume oil

55% sodium bicarbonate, mean particle diameter 200 μm ad 100% water, deionized

This Example represents an effective cleaner which shows high abrasiveness when used in undiluted form and a foam collapse of 93% when used in dilute form (3 ml/l).

EXAMPLES 5 AND 6

| | | |
|---|---|---|
| $C_{12/14}$ alkyl sulfate, Na salt | 5% | 5% |
| $C_{12/14}$ FA + 2.5 EO (narrow range) | 3.5% | 3.5% |
| $C_{12/14}$ FA + 4 EO (normal range) | 0.3% | 0.3% |
| Cocofatty acid | 1.2% | 1.2% |
| Glycerol | 0.5% | 0.5% |
| Sodium bicarbonate, mean particle diameter 200 μm | 50% | 50% |
| Gelatine | — | 0.5% |
| Water, deionized | ad 100 | ad 100 |
| Relative cleaning power at 3 ml/l | 100% | 115% |

Example 6 reflects the increase in cleaning power obtained by adding gelatine.

We claim:

1. A pourable, aqueous cleaning composition comprising:

(a) at least 50% by weight of sodium bicarbonate having a mean particle size of about 200±100 μm;

(b) from about 2 to 30% by weight of a low-foaming surfactant mixture selected from the group consisting of alkyl sulfates, alkyl ether sulfates, narrow-range ethoxylated alkyl polyglycol ethers and soap; and (c) water.

2. The composition of claim 1 containing from about 4 to 10% by weight of $C_8$–$C_{22}$ alkyl sulfates.

3. The composition of claim 1 containing from about 4 to 10% by weight of $C_8$–$C_{18}$ alkyl ether sulfates containing about 1 to 5 moles of ethylene oxide per mole of said ether sulfates.

4. The composition of claim 1 containing from about 1.5 to 8% by weight of narrow-range ethoxylated alkyl polyglycol ethers having a $C_8$–$C_{18}$ alkyl radical and about 2 to 8 moles of ethylene oxide per mole of said polyglycol ethers.

5. The composition of claim 1 containing from about 0.05 to 5% by weight of a soap selected from the group consisting of linear carboxylic acids having a $C_7$–$C_{22}$ alkyl radical, branched carboxylic acids having a $C_7$–$C_{22}$ alkyl radical, saturated carboxylic acids having a $C_7$–$C_{22}$ alkyl radical, unsaturated carboxylic acids having a $C_7$–$C_{22}$ alkyl radical, and mixtures thereof.

6. The composition of claim 5 wherein said carboxylic acids are present as a salt selected from the group consisting of alkali metal salts, ammonium salts, alkyl ammonium salts, and mixtures thereof.

7. The composition of claim 5 wherein said carboxylic acids are partly present as a salt selected from the group consisting of alkali metal salts, ammonium salts, alkyl ammonium salts, and mixtures thereof.

8. The composition of claim 1 containing up to about 5% by weight of polyols.

9. The composition of claim 1 containing from about 0.1 to 1.8% by weight of polymers.

10. The composition of claim 1 further containing cleaning composition components selected from the group consisting of perfume oils, organic builders, inorganic builders, solubilizers, preservatives, antimicrobially active compounds, dyes and mixtures thereof.

11. A process for cleaning substrates comprising contacting said substrates with an effective amount of a pourable, aqueous cleaning composition comprising:

(a) at least 50% by weight of sodium bicarbonate having a mean particle size of about 200±100 μm;

(b) from about 2 to 30% by weight a of low-foaming surfactant mixture selected from the group consisting of alkyl sulfates, alkyl ether sulfates, narrow-range ethoxylated alkyl polyglycol ethers and soap; and (c) water.

12. The process of claim 11 wherein said composition contains from about 4 to 10% by weight of $C_8$–$C_{22}$ alkyl sulfates.

13. The process of claim 11 wherein said composition contains from about 4 to 10% by weight of $C_8$–$C_{18}$ alkyl ether sulfates containing about 1 to 5 moles of ethylene oxide per mole of said ether sulfates.

14. The process of claim 11 wherein said composition contains from about 1.5 to 8% by weight of narrow-range ethoxylated alkyl polyglycol ethers having a $C_8$–$C_{18}$ alkyl radical and about 2 to 8 moles of ethylene oxide per mole of said polyglycol ethers.

15. The process of claim 11 wherein said composition contains from about 0.05 to 5% by weight of a soap selected from the group consisting of linear carboxylic acids having a $C_7$–$C_{22}$ alkyl radical, branched carboxylic acids having a $C_7$–$C_{22}$ alkyl radical, saturated carboxylic acids having a $C_7$–$C_{22}$ alkyl radical, unsaturated carboxylic acids having a $C_7$–$C_{22}$ alkyl radical, and mixtures thereof.

16. The process of claim 15 wherein said carboxylic acids are in salt form.

17. The process of claim 15 wherein said carboxylic acids are partly in salt form.

18. The process of claim 11 wherein said composition contains up to about 5% by weight of polyols.

19. The process of claim 11 wherein said composition contains from about 0.1 to 1.8% by weight of polymers.

20. The process of claim 11 wherein said composition further contains cleaning composition components selected from the group consisting of perfume oils, organic builders, inorganic builders, solubilizers, preservatives, antimicrobially active compounds, dyes and mixtures thereof.

* * * * *